United States Patent [19]

Garner

[11] 4,436,164

[45] Mar. 13, 1984

[54] LUBRICATION FAILURE DETECTION SYSTEM

[75] Inventor: Lloyd L. Garner, Ft. Worth, Tex.

[73] Assignee: Globe Oil Tools, Inc., Fort Worth, Tex.

[21] Appl. No.: 356,853

[22] Filed: Mar. 10, 1982

[51] Int. Cl.[3] ..... E21B 10/22

[52] U.S. Cl. ..... 175/39; 175/228

[58] Field of Search ..... 175/25, 38, 48, 228

[56] References Cited

U.S. PATENT DOCUMENTS

| | | | |
|---|---|---|---|
| 2,580,860 | 1/1952 | Stokes | 255/61 |
| 2,647,729 | 8/1953 | Del'Homme | 255/61 |
| 3,062,302 | 11/1962 | Toth et al. | 175/39 |
| 3,096,835 | 7/1963 | Neilson | 175/228 X |
| 3,853,184 | 12/1974 | McCullough | 175/39 |
| 4,284,149 | 8/1981 | Fox | 175/228 X |

*Primary Examiner*—Ernest R. Purser
*Assistant Examiner*—Joseph Falk
*Attorney, Agent, or Firm*—Hubbard, Thurman, Turner and Tucker

[57] ABSTRACT

A lubrication failure detection system for utilization with an earth boring drilling system having at least one rotary drill bit coupled to a drill string, the drill string having an internal passage adapted to receive drilling fluid under pressure. A lubrication reservoir is disposed near said rotary drill bit and coupled to bearing surfaces within said rotary drill bit by a lubrication passageway. A flexible membrane separates the lubrication reservoir from drilling fluid within the annulus formed by the rotary drill bit and distends inward in response to the pressure of the drilling fluid. The distention of the membrane forces lubricant into the lubrication passageway and when the membrane has distended to a selected point, the membrane actuates a mechanism which opens an orifice into the internal passage of the drill string, thereby abruptly decreasing the pressure of the drilling fluid within the drill string. The system also includes means for detecting this pressure drop, thereby indicating the imminent failure of lubrication within the system. In an alternate embodiment, the system includes means for selectively closing the aforementioned orifice to permit additional operation of the drilling system after imminent lubrication failure has been indicated.

19 Claims, 2 Drawing Figures

LUBRICATION FAILURE DETECTION SYSTEM

BACKGROUND OF THE INVENTION

This invention relates in general to systems for providing lubrication to rotary drill bits in earth boring systems and in particular to lubrication systems which include means for remotely detecting the imminent failure of the lubrication system.

The lubrication of earth boring drilling systems has long represented a problem in the area. The pressures and temperatures encountered by a rotary drill bit during an earth boring operation may fluctuate over a wide range. At a depth of ten thousand feet, the hydrostatic pressure near the bit may be as high as five thousand psi due to the weight of the drilling fluid in the well bore above the bit. Additionally, the friction of operation and the increase in depth will result in elevated temperatures at and near the drill bit. In order to solve these problems, known systems have been designed with pressure compensators to maintain lubricant pressure within the rotary drill bit. Such pressure compensators typically utilize a flexible membrane or diaphragm situated between a lubricant reservoir and the pressures exerted by the drilling fluid within the well bore. In this manner, the pressures of lubricant and drilling fluid may be equalized and proper lubricant flow to the bearing surfaces can be maintained as the lubricant is forced from the reservoir during higher pressure drilling operations.

It is this variable rate of lubricant utilization which presents a second problem in this area. A rotary drill bit cannot be operated for an extended period of time without lubrication without the possibility of damage to or complete failure of the drill bit. In such cases, the drill bit, or portions of it, may break off and the drill string must be removed and the drill bit must be fished out of the well bore at great expense in both time and effort. As a result, it is a common practice to operate a rotary drill bit for some predetermined period of time and then remove the drill bit and recharge the lubricant reservoir or replace the drill bit. This operation is also time consuming and may be inefficient due to the inability of the drilling operators to accurately gauge the amount of lubrication remaining in a drill bit. Thermocouples and other remote reading instrumentation approaches have not proven practical in this area.

SUMMARY OF THE INVENTION

It is therefore one object of the present invention to provide an improved lubrication system for rotary earth drilling bits.

It is another object of the present invention to provide an improved lubrication system for rotary earth drilling bits which includes an indication of imminent lubrication failure.

It is yet another object of the present invention to provide an improved lubrication system for rotary drill bits which provides a remote indication of imminent lubrication failure without the utilization of additional connections between the rotary drill bit and the surface.

It is another object of the present invention to provide an improved method of detecting the imminent lubrication failure in a rotary drill bit.

The foregoing objects are achieved as is now described. A lubrication failure detection system is implemented for utilization with an earth boring drilling system having at least one rotary drill bit coupled to a drill string, the drill string having an internal passage adapted to receive drilling fluid under pressure. At least one lubrication reservoir is disposed near said rotary drill bit and coupled to bearing surfaces within said rotary drill bit by a lubrication passageway. A flexible membrane separates the lubrication reservoir from drilling fluid within the annulus formed by the rotary drill bit and distends inward in response to the pressure of the drilling fluid. The distention of the membrane forces lubricant into the lubrication passageway and when the membrane has distended to a selected point, the membrane actuates a mechanism which opens an orifice into the internal passage of the drill string, thereby abruptly decreasing the pressure of the drilling fluid within the drill string. The system also includes means for detecting this pressure drop, thereby indicating the imminent failure of lubrication within the system. In an additional embodiment, the above described system also includes means for selectively closing the aforementioned orifice to permit additional operation of the drilling system after imminent lubrication failure has been indicated.

BRIEF DESCRIPTION OF THE FIGURES

The novel features believed characteristic of the invention are set forth in the appended claims. The invention itself; however, as well as a preferred mode of use, further objects and advantages thereof, will best be understood by reference to the following detailed description of an illustrative embodiment when read in conjunction with the accompanying drawings, wherein:

DETAILED DESCRIPTION OF THE INVENTION

Figure 1:
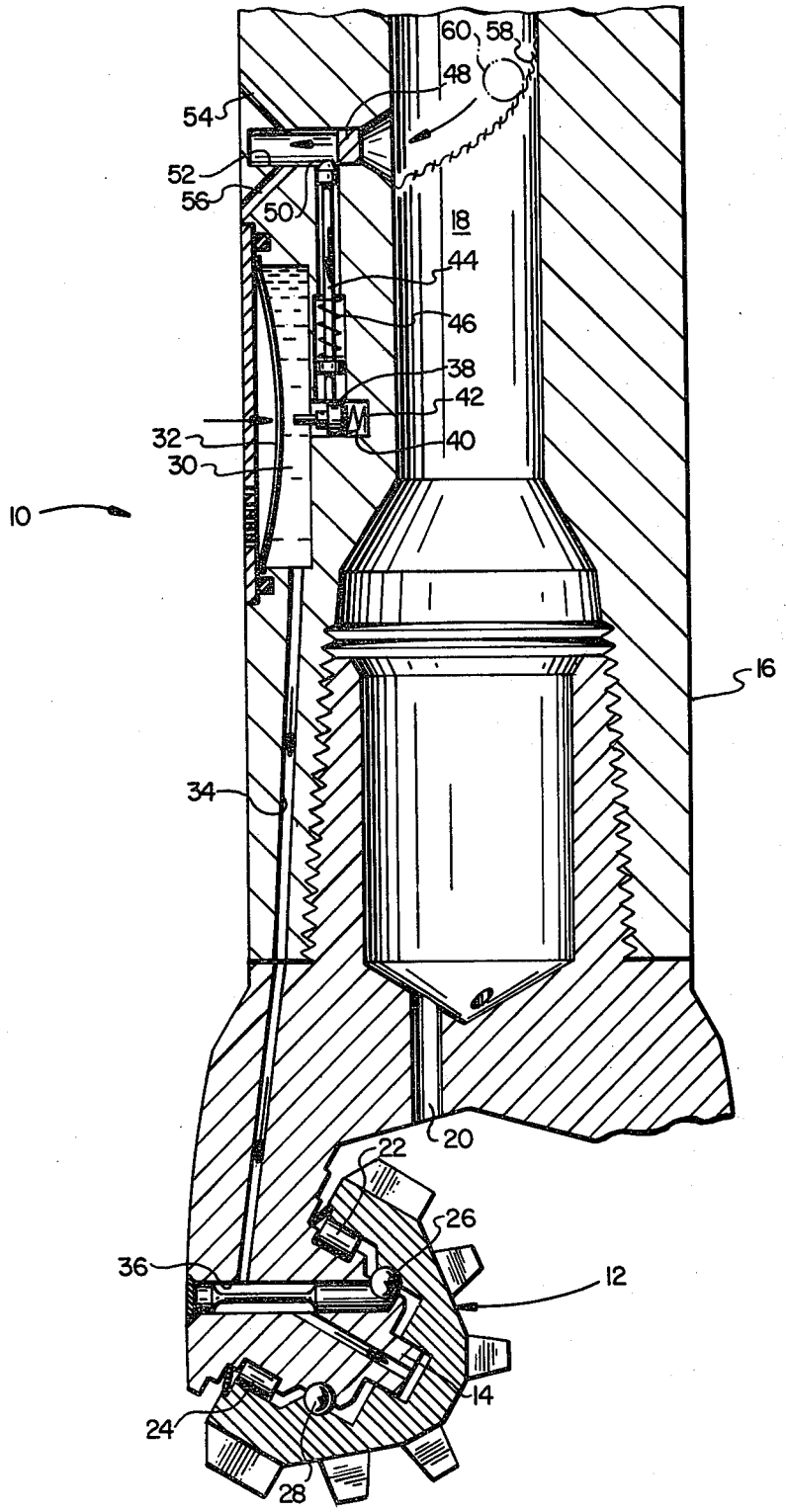
FIG. 1 is a sectional view of a portion of an earth boring drilling system incorporating the novel lubrication failure detection system of the present invention.

With reference now to the figures, and in particular with reference to FIG. 1, there is depicted a sectional view of an earth boring drilling system 10 which incorporates the novel lubrication failure detection system of the present invention. Earth boring drilling system 10 includes at least one cutter or rotating drillhead 12, which is mounted upon shaft 14. Shaft 14 is mounted in any suitable manner to drill string 16. Drill string 16 includes an internal passage 18, through which drilling fluid is conducted downwardly under pressure to orifice 20. The drilling fluid exuded from orifice 20 is directed at cutter 12 and is then forced upward in the annulus surrounding drill string 16 by the pressure of the drilling fluid supply. The drilling fluid is utilized to carry cuttings and debris from drilling operations to the surface. Those skilled in the art will appreciate that in a typical drilling operation a plurality of cutters and drilling fluid orifices will be utilized and that the drilling fluid must be supplied to the drill string at sufficient pressures to force drilling debris upward through the well bore.

It is this pressure of the drilling fluid, which is necessary to overcome the hydrostatic head of the column of drilling fluid within the well bore, which makes pressure compensation of the lubrication system necessary. Cutter 12 is typically mounted to shaft 14 by any combination of roller bearings such as roller bearings 22 and 24 and ball bearings such as ball bearings 26 and 28. Other types of bearing surfaces may also be used. Without a pressure compensating lubrication system the pressure of the drilling fluid would soon cause the drilling fluid and drilling debris to be forced into the bearing races and onto the bearing surfaces of cutter 12 thereby having an adverse effect upon continued operation of the system.

The pressure compensated lubrication system comprises lubricant reservoir 30 which is separated from the drilling fluid within the annulus by flexible membrane 32. Flexible membrane 32 is typically constructed of neoprene or other flexible material and may also be fabricated from a flexible metallic substance. As the pressure of drilling fluid upon flexible membrane 32 increases, lubricant is forced out of reservoir 30 into lubrication passageway 34. Lubrication passageway 34 is coupled, in one embodiment of the present invention, to a central lubrication channel 36 within shaft 14. The lubricant within channel 36 is then applied, under pressure, to the bearings, bearing races and bearing surfaces upon which cutter 12 is mounted. Thus, the lubricant within the system is kept at a pressure which corresponds to the ambient pressure of the drilling fluid surrounding cutter 12, and drilling fluid and debris are kept out of the bearing surfaces upon which cutter 12 will rotate.

An important feature of the present invention is the novel manner in which the imminent failure of the lubrication system may be detected at the surface above earth boring drilling system 10. Piston 38 is mounted within bore 40 and biased toward membrane 32 by spring 42. As membrane 32 reaches a point near the maximum distention into lubrication reservoir 30, membrane 32 will contact piston 38 and urge piston 38 into bore 40 against the bias provided by spring 42. As piston 38 is urged further into bore 40, the lowered shoulder portion of piston 38 will be positioned beneath rod 44. Rod 44 is then urged downward by the combined forces of spring 46 and the pressure of plug 48 upon cam surface 50.

As rod 44 moves downward, the pressure of drilling fluid within internal passageway 18, which is exerted upon plug 48, will force plug 48 into the outermost portion of bore 52, thus coupling passages 54 and 56 to internal passage 18 through bore 52. This additional passage will permit a much higher volume of drilling fluid to be output from internal passage 18 and will result in a notable drop in the pressure of drilling fluid within internal passage 18. Those skilled in the art will appreciate that by monitoring the pressure of drilling fluid within internal passage 18, a drilling operator will be able to detect this pressure drop and thereby determine that failure of the lubrication system due to depletion of the lubricant is imminent.

In an alternate embodiment, means are provided for temporarily, blocking bore 52 to permit operation of earth boring drilling system 10 for an additional period of time after plug 48 has been released. In such applications, a coarse grid or mesh 58 is positioned in internal passage 18 as depicted in FIG. 1. After the drop in drilling fluid pressure has been detected, a ball check 60 may be dropped into internal passage 18. Ball check 60 will be directed into bore 52 by mesh 58 and will lodge against the beveled sides of bore 52. In this manner, bore 52 may be effectively closed, and the operation of earth boring drilling system 10 may continue for a short period of time after imminent lubrication failure has been indicated.

Figure 2:
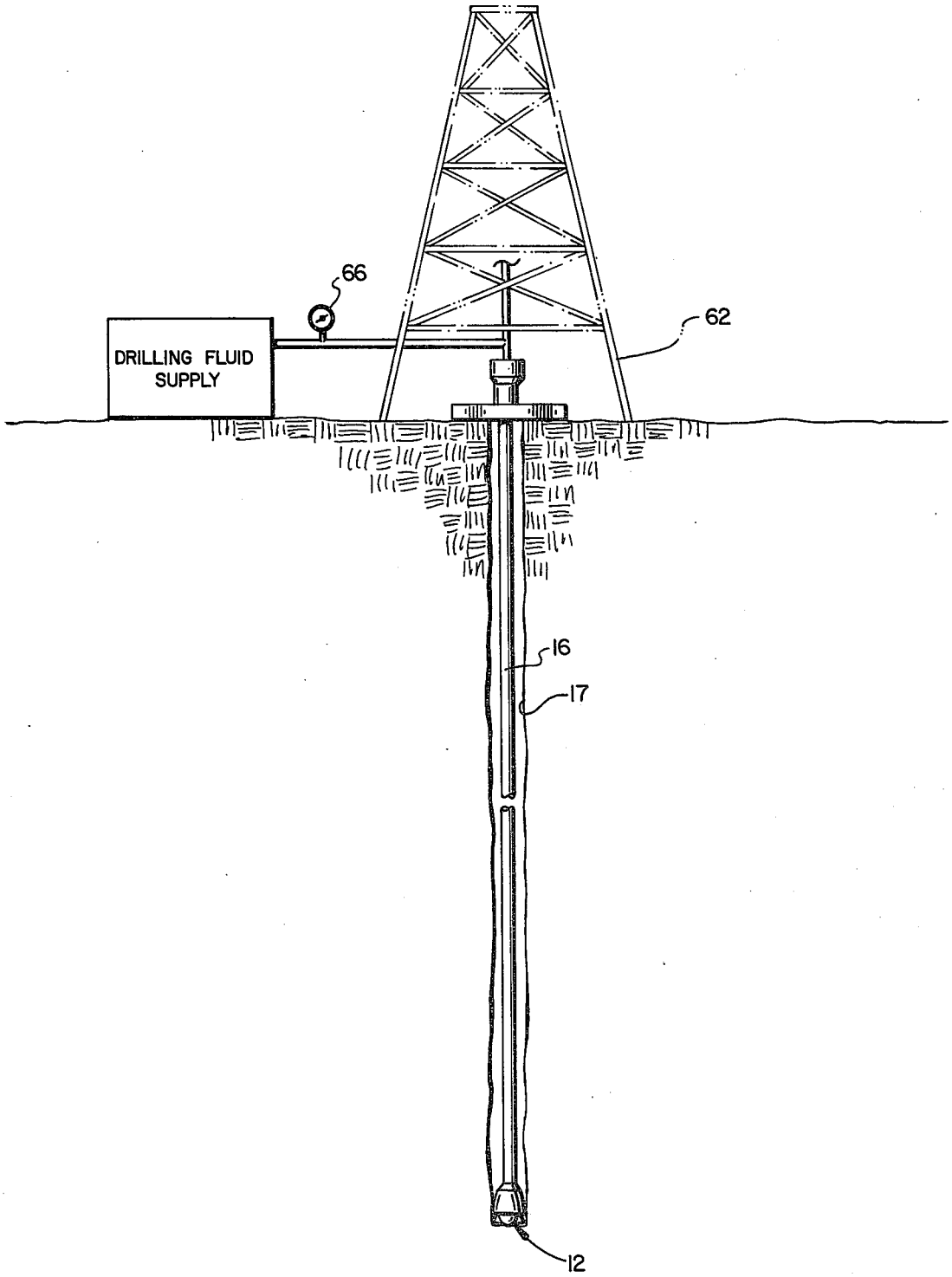
FIG. 2 is a partially schematic view of a portion of an earth boring drilling system incorporating the novel lubrication failure detection system of the present invention.

Referring now to FIG. 2, there is depicted a partially schematic view of the lubrication failure detection system of the present invention. FIG. 2 depicts the drill string 16 within an annulus or well bore 17 in the earth. At the surface of the earth a drilling platform 62 supports the machinery for operating earth boring drilling system 10. A drilling fluid supply source 64 is coupled to internal passage 18 (not shown) of drill string 16 through pressure gauge 66. Pressure gauge 66 is utilized to detect the drop in drilling fluid pressure created by the opening of bore 52 (also not shown). In alternate embodiments pressure gauge 66 may be monitored by an operator or coupled to an electronic circuit for pressure drop detection.

Although the invention has been described with reference to a specific embodiment, this description is not meant to be construed in a limiting sense. Various modifications of the disclosed embodiment as well as alternative embodiments of the invention will become apparent to persons skilled in the art upon reference to the description of the invention. It is therefore contemplated that the appended claims will cover any such modifications or embodiments that fall within the true scope of the invention.

What is claimed is:

1. A lubrication failure detection system for use in conjunction with an earth boring drilling system having at least one rotary drill bit coupled to a drill string, said drill string including an internal passage adapted to receive drilling fluid under pressure at a first end thereof and including at least a first orifice at a second end thereof for directing said drilling fluid into the bottom of the annulus formed by said drilling system, said lubrication failure detection system comprising:

at least one lubricant chamber for storing a reservoir of lubricant;

a passageway coupling said lubricant chamber to a bearing surface within said at least one rotary drill bit;

a flexible membrane interposed between said lubricant chamber and said annulus, said flexible membrane adapted to distend inwardly in response to the pressure of said drilling fluid within said annulus, thereby forcing lubricant into said passageway;

a second orifice between said internal passage and said annulus;

a plug within said second orifice and a mechanical linkage means responsive to a selected distention of said flexible membrane for releasing said plug; and second means for detecting a reduction in pressure of said drilling fluid within said internal passage when said second orifice is opened.

2. The lubrication failure detection system according to claim 1 further including a plurality of lubricant chambers each coupled by a passageway to bearing surfaces within each of a plurality of rotary drill bits.

3. The lubrication failure detection system according to claim 1 wherein said flexible membrane is comprised of neoprene.

4. The lubrication failure detection system according to claim 1 wherein said flexible membrane is comprised of a metallic substance.

5. The lubrication failure detection system according to claim 1 wherein said second means comprises a pressure gauge disposed at the surface of the earth above said earth boring drilling system.

6. The lubrication failure detection system according to claim 1 further including means for selectively closing said second orifice.

7. The lubrication failure detection system according to claim 6 wherein said means for selectively closing said second orifice comprises a spherical member and guide means for directing said spherical member into said second orifice.

8. The lubrication failure detection system according to claim 7 wherein said means for directing said spherical member into said second orifice comprises a coarse mesh disposed within said internal passage of said drill string whereby drilling fluid will flow through said internal passage and said spherical member is obstructed and guided into said second orifice.

9. A lubrication failure detection system for use in conjunction with an earth boring drilling system having at least one rotary drill bit coupled to a drill string, said drill string including an internal passage adapted to receive drilling fluid under pressure at a first end thereof and including at least a first orifice at a second end thereof for directing said drilling fluid into the bottom of the annulus formed by said drilling system, said lubrication failure detection system comprising:

at least one lubricant chamber for storing a reservoir of lubricant;

a passageway coupling said lubricant chamber to a bearing surface within said at least one rotary drill bit;

a flexible membrane interposed between said lubricant chamber and said annulus, said flexible membrane adapted to distend inwardly in response to the pressure of said drilling fluid within said annulus, thereby forcing lubricant into said passageway;

a piston disposed adjacent to said flexible membrane and displaceable within a bore in response to distention of said flexible membrane;

a second orifice between said internal passage and said annulus;

a plug within said second orifice and a linkage rod responsive to a selected displacement of said piston for releasing said plug; and detection means for detecting a reduction in pressure of said drilling fluid within said internal passage when said second orifice is opened.

10. The lubrication failure detection system according to claim 9 further including a plurality of lubricant chambers each coupled by a passageway to bearing surfaces within each of a plurality of rotary drill bits.

11. The lubrication failure detection system according to claim 9 wherein said flexible membrane is comprised of neoprene.

12. The lubrication failure detection system according to claim 9 wherein said flexible membrane is comprised of a metallic substance.

13. The lubrication failure detection system according to claim 9 wherein said second means comprises a pressure gauge disposed at the surface of the earth above said earth boring drilling system.

14. The lubrication failure detection system according to claim 9 further including means for selectively closing said second orifice.

15. The lubrication failure detection system according to claim 14 wherein said means for selectively closing said second orifice comprises a spherical member and guide means for directing said spherical member into said second orifice.

16. The lubrication failure detection system according to claim 15 wherein said means for directing said spherical member into said second orifice comprises a coarse mesh disposed within said internal passage of said drill string whereby drilling fluid will flow through said internal passage and said spherical member is obstructed and guided into said second orifice.

17. A lubrication failure detection system for use in conjunction with an earth boring drilling system having at least one rotary drill bit coupled to a drill string, said drill string including an internal passage adapted to receive drilling fluid under pressure at a first end thereof and including at least a first orifice at a second end thereof for directing said drilling fluid into the bottom of the annulus formed by said drilling system, said lubrication failure detection system comprising:

at least one lubricant chamber for storing a reservoir of lubricant;

a passageway coupling said lubricant chamber to a bearing surface within said at least one rotary drill bit;

a flexible membrane interposed between said lubricant chamber and said annulus, said flexible membrane adapted to distend inwardly in response to the pressure of said drilling fluid within said annulus, thereby forcing lubricant into said passageway;

first means responsive to a selective amount of distention of said flexible membrane for opening a second orifice between said internal passage and said annulus;

second means for detecting a reduction in pressure of said drilling fluid within said internal passage when said second orifice is opened; and means for selectively closing said second orifice.

18. The lubrication failure detection system according to claim 17 wherein said means for selectively closing said second orifice comprises a spherical member and guide means for directing said spherical member into said second orifice.

19. The lubrication failure detection system according to claim 18 wherein said means for directing said spherical member into said second orifice comprises a coarse mesh disposed within said internal passage of said drill string whereby drilling fluid will flow through said internal passage and said spherical member is obstructed and guided into said second orifice.

* * * * *